US011604423B2

(12) United States Patent
Osato et al.

(10) Patent No.: US 11,604,423 B2
(45) Date of Patent: Mar. 14, 2023

(54) REMAINING TONER AMOUNT DETECTION DEVICE, IMAGE FORMING APPARATUS, AND REMAINING TONER AMOUNT DETECTION METHOD

(71) Applicants: Yuki Osato, Tokyo (JP); Masashi Hommi, Kanagawa (JP); Yuusuke Tomura, Kanagawa (JP); Ryotaro Konno, Kanagawa (JP); Junichi Matsumoto, Kanagawa (JP); Tatsuya Kubo, Kanagawa (JP)

(72) Inventors: Yuki Osato, Tokyo (JP); Masashi Hommi, Kanagawa (JP); Yuusuke Tomura, Kanagawa (JP); Ryotaro Konno, Kanagawa (JP); Junichi Matsumoto, Kanagawa (JP); Tatsuya Kubo, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/652,753

(22) Filed: Feb. 28, 2022

(65) Prior Publication Data

US 2022/0283533 A1 Sep. 8, 2022

(30) Foreign Application Priority Data

Mar. 8, 2021 (JP) ..... JP2021-036450

(51) Int. Cl.
*G03G 15/08* (2006.01)
*G03G 15/00* (2006.01)

(52) U.S. Cl.
CPC ..... *G03G 15/0856* (2013.01); *G03G 15/086* (2013.01); *G03G 15/0872* (2013.01); *G03G 15/556* (2013.01)

(58) Field of Classification Search
CPC ..... G03G 15/0856; G03G 15/086; G03G 15/0872; G03G 15/556; G03G 21/0665
(Continued)

(56) References Cited

U.S. PATENT DOCUMENTS 5,465,619 A * 11/1995 Sotack ..... G03G 15/0856 118/694
6,163,669 A 12/2000 Aoki et al.
(Continued)

FOREIGN PATENT DOCUMENTS

JP 2004-286792 10/2004
JP 2016-071299 5/2016
(Continued)

OTHER PUBLICATIONS

U.S. Appl. No. 17/467,468, filed Sep. 7, 2021, Tatsuya Kubo, et al.
(Continued)

*Primary Examiner* — Robert B Beatty
(74) *Attorney, Agent, or Firm* — IPUSA, PLLC

(57) ABSTRACT

A remaining toner amount detection device includes four electrodes and a controller. Each electrode has an arc shape along an outer circumferential surface of a toner bottle, and the four electrodes are spaced a certain distance apart in a circumferential direction so as to surround the toner bottle. The controller detects a remaining toner amount inside the toner bottle by using the four electrodes. The controller determines whether at least one of a first electrostatic capacity value between one pair of adjacent electrodes and a second electrostatic capacity value between the other pair of adjacent electrodes falls within a threshold range. In response to determination that at least one of the electrostatic capacity values falls within the threshold range, the controller detects a remaining toner amount inside the toner
(Continued)

bottle based on an electrostatic capacity value, and outputs the detected remaining toner amount.

8 Claims, 9 Drawing Sheets

(58) Field of Classification Search
USPC ..... 399/27, 30, 58, 262
See application file for complete search history.

(56) References Cited

U.S. PATENT DOCUMENTS

| | | | | |
|---|---|---|---|---|
| 6,295,437 | B1 | 9/2001 | Hodoshima et al. | |
| 6,393,241 | B1 | 5/2002 | Matsumoto et al. | |
| 6,600,984 | B1 | 8/2003 | Junichi et al. | |
| 10,996,606 | B2 * | 5/2021 | Leiri | G03G 15/55 |
| 2001/0021326 | A1 | 9/2001 | Yanagisawa et al. | |
| 2001/0052526 | A1 | 12/2001 | Kasahara et al. | |
| 2002/0009310 | A1 | 1/2002 | Kabumoto et al. | |
| 2002/0025195 | A1 | 2/2002 | Iwata et al. | |
| 2002/0025196 | A1 | 2/2002 | Matsumoto et al. | |
| 2002/0039502 | A1 | 4/2002 | Matsumoto et al. | |
| 2002/0106221 | A1 | 8/2002 | Muramatsu et al. | |
| 2002/0164178 | A1 | 11/2002 | Muramatsu et al. | |
| 2003/0012586 | A1 | 1/2003 | Iwata et al. | |
| 2003/0081969 | A1 | 5/2003 | Muramatsu et al. | |
| 2003/0198487 | A1 | 10/2003 | Yanagisawa et al. | |
| 2003/0235436 | A1 | 12/2003 | Kasahara et al. | |
| 2004/0013963 | A1 | 1/2004 | Muramatsu et al. | |
| 2004/0033088 | A1 | 2/2004 | Muramatsu et al. | |
| 2004/0091287 | A1 | 5/2004 | Matsumoto et al. | |
| 2004/0131392 | A1 | 7/2004 | Matsumoto et al. | |
| 2004/0179866 | A1 | 9/2004 | Muramatsu et al. | |
| 2004/0197119 | A1 | 10/2004 | Matsumoto et al. | |
| 2004/0197120 | A1 | 10/2004 | Yanagisawa et al. | |
| 2004/0197121 | A1 | 10/2004 | Muramatsu et al. | |
| 2005/0025527 | A1 | 2/2005 | Matsumoto et al. | |
| 2005/0089347 | A1 | 4/2005 | Muramatsu et al. | |
| 2005/0095037 | A1 | 5/2005 | Koike et al. | |
| 2005/0180782 | A1 | 8/2005 | Matsumoto et al. | |
| 2005/0226655 | A1 | 10/2005 | Katsuyama et al. | |
| 2005/0265759 | A1 | 12/2005 | Takeuchi et al. | |
| 2006/0008281 | A1 | 1/2006 | Matsumoto et al. | |
| 2006/0099006 | A1 | 5/2006 | Yanagisawa et al. | |
| 2006/0140679 | A1 | 6/2006 | Iwata et al. | |
| 2006/0216069 | A1 | 9/2006 | Tsujita et al. | |
| 2007/0053721 | A1 | 3/2007 | Matsumoto et al. | |
| 2007/0154242 | A1 | 7/2007 | Matsumoto et al. | |
| 2007/0264053 | A1 | 11/2007 | Iwata et al. | |
| 2007/0274742 | A1 | 11/2007 | Nakayama et al. | |
| 2008/0038019 | A1 | 2/2008 | Kasahara et al. | |
| 2008/0069596 | A1 | 3/2008 | Katsuyama et al. | |
| 2008/0199205 | A1 | 8/2008 | Kubo et al. | |
| 2008/0213006 | A1 | 9/2008 | Nakayama et al. | |
| 2008/0226349 | A1 | 9/2008 | Iwata et al. | |
| 2008/0247786 | A1 | 10/2008 | Nakayama et al. | |
| 2008/0298844 | A1 | 12/2008 | Katoh et al. | |
| 2008/0298845 | A1 | 12/2008 | Ohmura et al. | |
| 2008/0298866 | A1 | 12/2008 | Matsumoto et al. | |
| 2009/0067886 | A1 | 3/2009 | Nodera et al. | |
| 2009/0185832 | A1 | 7/2009 | Muramatsu et al. | |
| 2010/0124443 | A1 | 5/2010 | Ohmura et al. | |
| 2011/0044726 | A1 | 2/2011 | Katoh et al. | |
| 2011/0182610 | A1 | 7/2011 | Ohmura et al. | |
| 2011/0229207 | A1 | 9/2011 | Matsumoto et al. | |
| 2012/0027466 | A1 | 2/2012 | Nakayama et al. | |
| 2012/0039627 | A1 | 2/2012 | Kubo et al. | |
| 2012/0163875 | A1 | 6/2012 | Tateyama et al. | |
| 2012/0213555 | A1 | 8/2012 | Komatsu et al. | |
| 2012/0230733 | A1 | 9/2012 | Kikuchi et al. | |
| 2012/0230736 | A1 | 9/2012 | Hosokawa et al. | |
| 2013/0315636 | A1 | 11/2013 | Takayama et al. | |
| 2013/0330105 | A1 | 12/2013 | Komatsu et al. | |
| 2014/0320906 | A1 | 10/2014 | Fujimori et al. | |
| 2014/0321885 | A1 | 10/2014 | Fujimori et al. | |
| 2014/0321886 | A1 | 10/2014 | Kikuchi et al. | |
| 2015/0104218 | A1 | 4/2015 | Komatsu et al. | |
| 2015/0261134 | A1 | 9/2015 | Kikuchi et al. | |
| 2015/0323884 | A1 | 11/2015 | Kikuchi et al. | |
| 2015/0338775 | A1 | 11/2015 | Hosokawa et al. | |
| 2015/0346635 | A1 | 12/2015 | Nodera et al. | |
| 2016/0136947 | A1 | 5/2016 | Hommi | |
| 2016/0238966 | A1 | 8/2016 | Oshikawa et al. | |
| 2017/0115597 | A1 | 4/2017 | Kawashima et al. | |
| 2017/0227922 | A1 | 8/2017 | Takami et al. | |
| 2018/0341199 | A1 * | 11/2018 | Yamashita | G03G 15/556 |
| 2019/0204775 | A1 | 7/2019 | Takami et al. | |
| 2019/0339642 | A1 | 11/2019 | Takami et al. | |
| 2020/0033751 | A1 | 1/2020 | Matsumoto et al. | |
| 2020/0033752 | A1 | 1/2020 | Kubo et al. | |
| 2020/0183302 | A1 | 6/2020 | Nodera et al. | |
| 2020/0301313 | A1 | 9/2020 | Suganuma et al. | |
| 2020/0301357 | A1 | 9/2020 | Hommi et al. | |
| 2020/0333725 | A1 | 10/2020 | Tomura et al. | |
| 2021/0033997 | A1 | 2/2021 | Kubo et al. | |
| 2021/0034007 | A1 | 2/2021 | Tamaki et al. | |
| 2021/0080864 | A1 | 3/2021 | Nodera et al. | |
| 2021/0116842 | A1 | 4/2021 | Hosokawa et al. | |
| 2021/0124286 | A1 | 4/2021 | Matsumoto et al. | |
| 2021/0364949 | A1 | 11/2021 | Matsumoto et al. | |
| 2021/0405562 | A1 | 12/2021 | Morimoto et al. | |

FOREIGN PATENT DOCUMENTS

| | | |
|---|---|---|
| JP | 2020-020888 | 2/2020 |
| JP | 2020-034780 | 3/2020 |

OTHER PUBLICATIONS

U.S. Appl. No. 17/494,834, filed Oct. 6, 2021, Hotaru Hashikawa, et al.

U.S. Appl. No. 17/498,113, filed Oct. 11, 2021, Tatsumi Yamada, et al.

* cited by examiner

REMAINING TONER AMOUNT DETECTION DEVICE, IMAGE FORMING APPARATUS, AND REMAINING TONER AMOUNT DETECTION METHOD

CROSS-REFERENCE TO RELATED APPLICATION

This patent application is based on and claims priority pursuant to 35 U.S.C. § 119 to Japanese Patent Application No. 2021-036450, filed on Mar. 8, 2021, in the Japan Patent Office, the entire disclosure of which is hereby incorporated by reference herein.

BACKGROUND

Technical Field

Exemplary aspects of the present disclosure relate to a remaining toner amount detection device, an image forming apparatus, and a remaining toner amount detection method.

Related Art

An electrophotographic method is conventionally known as one of image forming methods for image forming apparatuses. In the electrophotographic method, an image is developed on a surface of a photoconductor drum with toner stored in a toner bottle, and the image developed on the photoconductor drum is transferred to a medium.

For the electrophotographic image forming apparatus, there is a technique for detecting an amount of toner remaining inside a toner bottle. According such a technique, a pair of electrodes is arranged such that the toner bottle is set between the electrodes, and an amount of toner remaining inside the toner bottle is detected as a change in electrostatic capacity between the electrodes.

SUMMARY

In at least one embodiment of this disclosure, there is described an improved remaining toner amount detection device that includes four electrodes and a controller. Each of the four electrodes is formed in an arc shape along an outer circumferential surface of a toner bottle, and the four electrodes are spaced a certain distance apart in a circumferential direction so as to surround the toner bottle. The controller detects a remaining toner amount inside the toner bottle by using the four electrodes. The controller determines whether at least one of a first electrostatic capacity value between one pair of electrodes adjacent to each other and a second electrostatic capacity value between the other pair of electrodes adjacent to each other out of the four electrodes falls within a threshold range. In response to a determination that at least one of the first electrostatic capacity value and the second electrostatic capacity value falls within the threshold range, the controller detects a remaining toner amount inside the toner bottle based on an electrostatic capacity value, and outputs the detected remaining toner amount.

Further described is an improved image forming apparatus that includes the remaining toner amount detection device described above, and an image forming device to form an image on a medium with toner inside the toner bottle.

Still further described is an improved remaining toner amount detection method that includes determining and detecting. The determining determines whether at least one of a first electrostatic capacity value between one pair of electrodes adjacent to each other and a second electrostatic capacity value between the other pair of electrodes adjacent to each other out of four electrodes falls within a threshold range. The four electrodes are formed in arc shapes and spaced a certain distance apart along an outer circumferential surface of a toner bottle. The detecting detects a remaining toner amount inside the toner bottle based on an electrostatic capacity value, and outputs the detected remaining toner amount, in response to a determination that at least one of the first electrostatic capacity value and the second electrostatic capacity value falls within the threshold range.

BRIEF DESCRIPTION OF THE DRAWINGS

The aforementioned and other aspects, features, and advantages of the present disclosure are better understood by reference to the following detailed description when considered in connection with the accompanying drawings, wherein.

Figure 1:
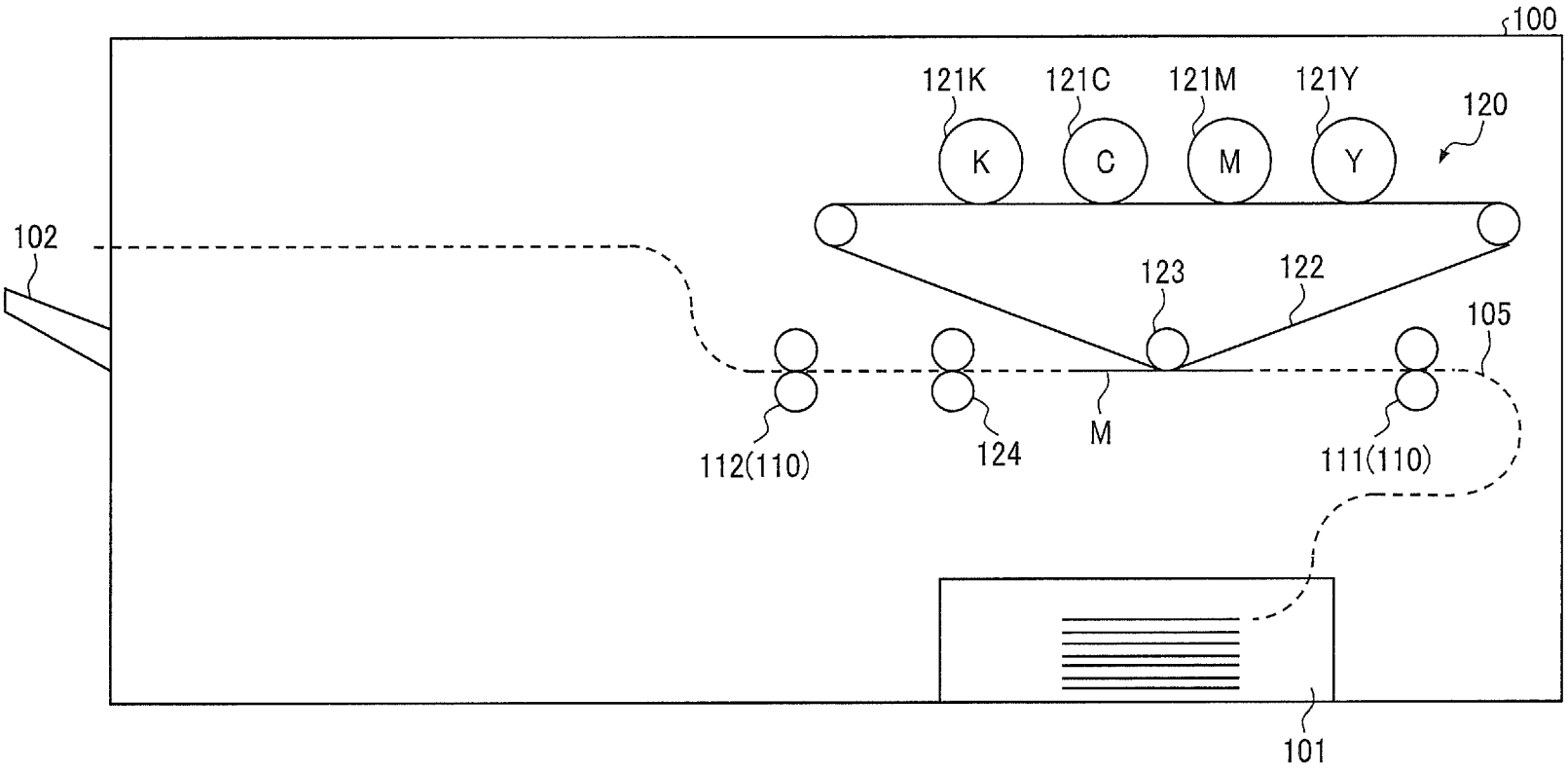
FIG. 1 is a schematic diagram illustrating an internal configuration of an image forming apparatus.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner and achieve similar results.

Referring now to the drawings, embodiments of the present disclosure are described below. In the drawings for explaining the following embodiments, the same reference codes are allocated to elements (members or components) having the same function or shape and redundant descriptions thereof are omitted below.

FIG. 1 is a schematic diagram illustrating an internal configuration of an image forming apparatus 100. As illustrated in FIG. 1, the image forming apparatus 100 mainly includes a sheet tray 101, an output tray 102, a conveyance device 110, and an image forming device 120. In the sheet tray 101, a plurality of sheets M prior to image formation is stored in a stacked state. In the output tray 102, a sheet M on which an image has been formed is stored.

A sheet M is one example of a medium that is conveyed by the conveyance device 110 and on which an image is to be formed by the image forming device 120. The sheet M can be, for example, a cut sheet that is cut beforehand in a predetermined size (e.g., A4 and B5), and long-belt-like continuous paper. The sheet M is not limited to paper. The sheet M can be a medium such as an overhead projector (OHP) sheet. In the image forming apparatus 100, a conveyance path 105 as space along which the sheet M is conveyed is formed. The conveyance path 105 is a path from the sheet tray 101 to the output tray 102 via the image forming device 120.

The conveyance device 110 conveys a sheet M along the conveyance path 105. Particularly, the conveyance device 110 conveys a sheet M stored in the sheet tray 101 to a position of the image forming device 120 along the conveyance path 105. In addition, the conveyance device 110 ejects the sheet M having a surface on which an image has been formed by the image forming device 120 to the output tray 102 along the conveyance path 105.

The conveyance device 110 includes a plurality of conveyance rollers 111 and 112. The conveyance rollers 111 and 112 include, for example, drive rollers and driven rollers. The drive roller is rotated by a driving force transmitted from a motor, and the driven roller is rotated by contacting the drive roller. The drive roller and the driven roller nip the sheet M and are rotated, so that the sheet M is conveyed along the conveyance path 105.

The conveyance roller 111 is disposed upstream of the image forming device 120 in a conveyance direction, whereas the conveyance roller 112 is disposed downstream of the image forming device 120 in the conveyance direction. However, positions of the conveyance rollers are not limited to two locations illustrated in FIG. 1

The image forming device 120 is disposed to face the conveyance path 105 between the conveyance rollers 111 and 112. The image forming device 120 forms an image on a surface of the sheet M conveyed by the conveyance device 110. The image forming device 120 according to the embodiment electrophotographically forms an image on the sheet M conveyed along the conveyance path 105.

More particularly, the image forming device 120 includes photoconductor drums 121Y, 121M, 121C, and 121K (hereinafter, collectively called "photoconductor drums 121" as necessary) for respective colors. The photoconductor drums 121 are disposed along a transfer belt 122 that is an endless moving member. That is, along the transfer belt 122 on which an intermediate transfer image to be transferred to the sheet M fed from sheet tray 101 is formed, the plurality of photoconductor drums 121Y 121M, 121C, and 121K is arranged in order from an upstream side in a direction of movement of the transfer belt 122.

Toner stored in a toner bottle 130 described below is supplied to the photoconductor drum 121. Then, images that are developed with the respective colors of toner on surfaces of the photoconductor drums 121 for the respective colors are overlapped and transferred to the transfer belt 122, so that a full-color image is formed. The full-color image formed on the transfer belt 122 is transferred to the sheet M by a transfer roller 123 in a position where the full-color image on the transfer belt 122 is closest to the conveyance path 105.

Moreover, the image forming device 120 includes a fixing roller 124 disposed downstream of the transfer roller 123 in the conveyance direction. The fixing roller 124 includes a drive roller that is rotated by a motor, and a driven roller that is rotated by contacting the drive roller. In a course of rotation of the drive roller and the driven roller with the sheet M nipped, the sheet M is heated and pressed. Thus, the image transferred by the transfer roller 123 is fixed on the sheet M.

Figure 2:
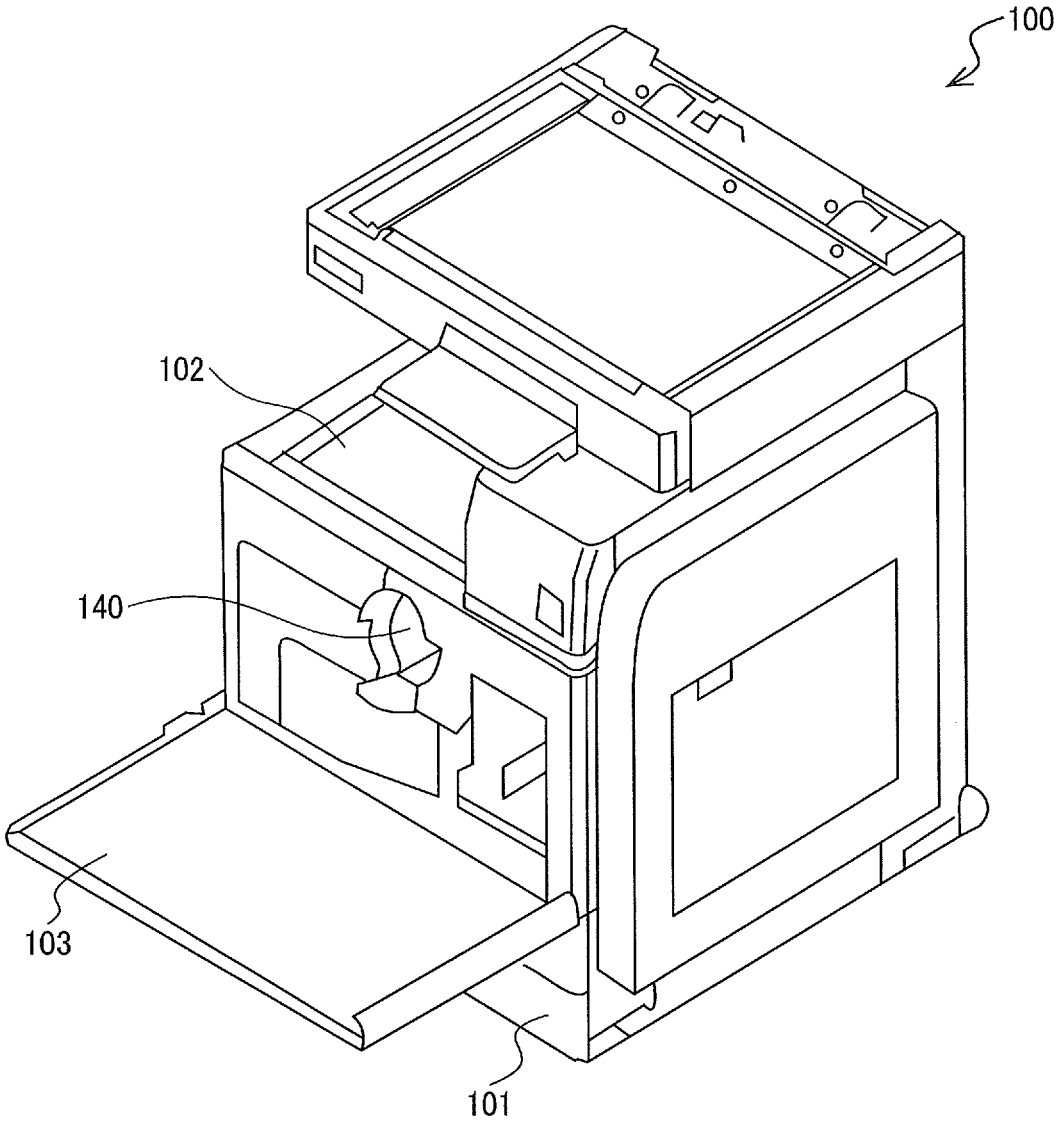
FIG. 2 is an external view illustrating the image forming apparatus.

FIG. 2 is an external view of the image forming apparatus 100. As illustrated in FIG. 2, an openable cover 103 is attached to a front surface of the image forming apparatus 100. When the cover 103 is opened, a toner bottle accommodation portion 140 in which the toner bottle 130 is accommodated is exposed. Although there is one toner bottle accommodation portion 140 in FIG. 2, the image forming apparatus 100 includes four toner bottle accommodation portion 140 in which respective toner bottles 130 for the respective colors (yellow, magenta, cyan, and black) are accommodated.

Figure 3A:
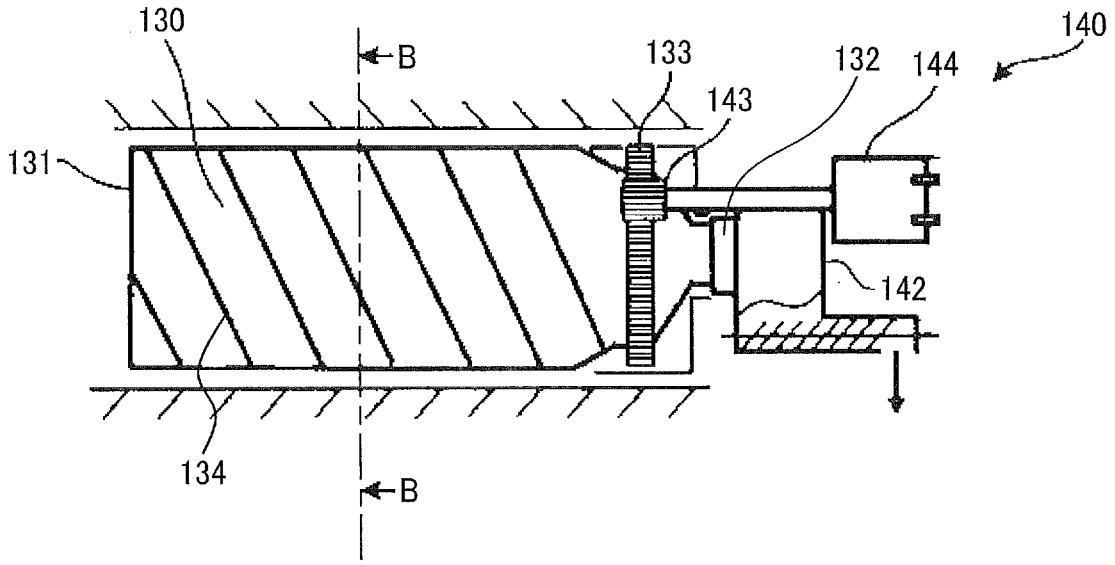
FIGS. 3A and 3B are schematic diagrams each illustrating a toner bottle accommodation portion in which a toner bottle is accommodated.
Figure 3B:
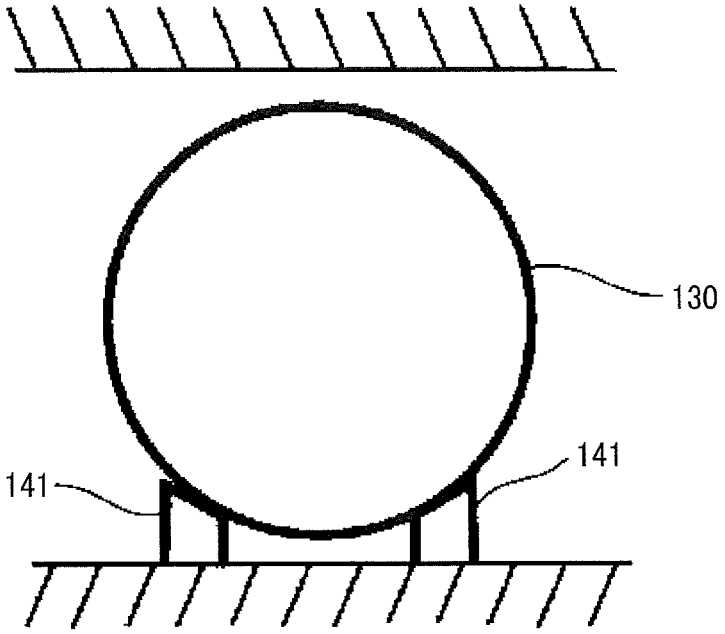
Figure 4A:
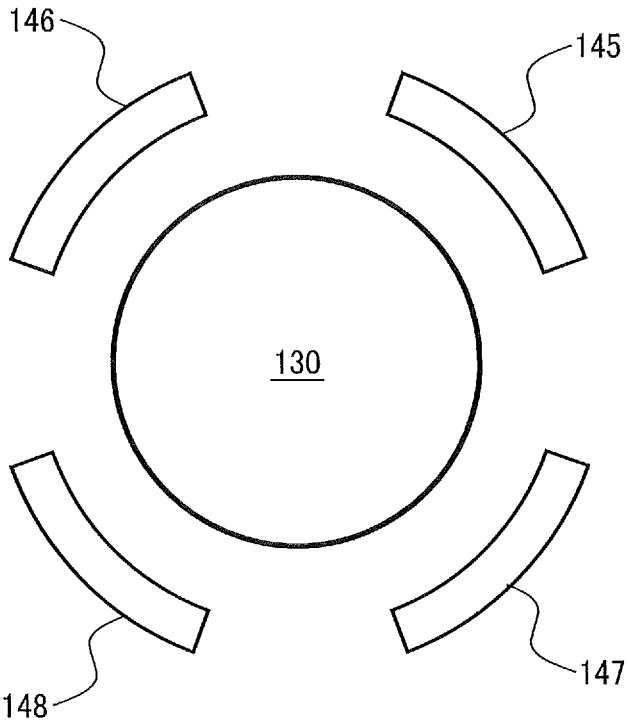
FIGS. 4A and 4B are diagrams each illustrating arrangement of the toner bottle and four electrodes.
Figure 4B:
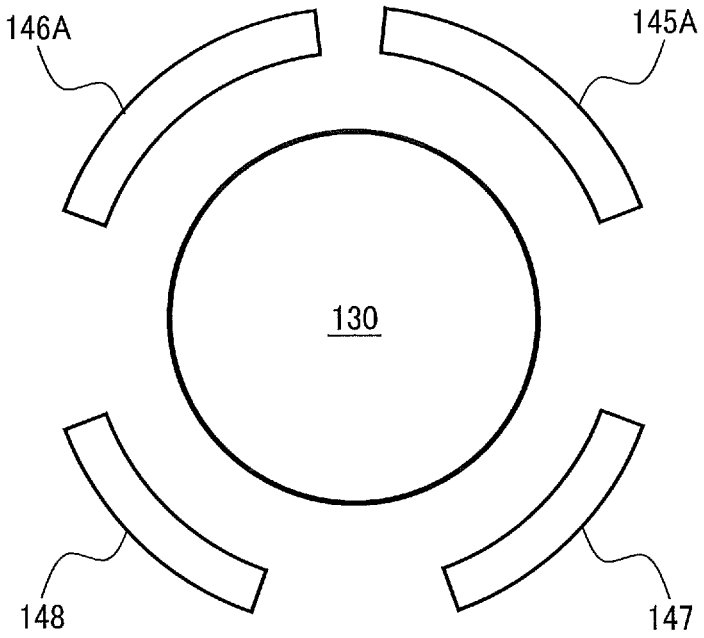

Next, the toner bottle 130 and the toner bottle accommodation portion 140 are described in detail with reference to FIGS. 3A, 3B, 4A, and 4B. Each of FIGS. 3A and 3B is a schematic diagram of the toner bottle accommodation portion 140 in which the toner bottle 130 is accommodated. FIG. 4A is a diagram illustrating arrangement of the toner bottle 130 and four electrodes 145, 146, 147, and 148. FIG. 4B is a diagram illustrating arrangement of the toner bottle 130 and four electrodes 145A, 146A, 147, and 148.

As illustrated in FIG. 3A, the toner bottle 130 mainly includes a tubular container body 131 in which toner is stored, a cap 132, and a gear 133. The cap 132 is attached to an end of the container body 131, and the gear 133 is fixed to an outer circumferential surface of the container body 131. The container body 131 is configured to be rotatable relative to the cap 132. On the container body 131, a helical projection 134 is formed. The helical projection 134 projects inward from an inner circumferential surface and helically extends The toner bottle accommodation portion 140 mainly includes two guides 141, a hopper 142, a drive gear 143, and a drive motor 144. The guides 141 support the toner bottle 130. The hopper 142 is connected to the cap 132 to supply toner inside the toner bottle 130 to the image forming device 120. The drive gear 143 meshes with the gear 133, and the drive motor 144 drives the drive gear 143.

When the toner bottle 130 is accommodated in the toner bottle accommodation portion 140, the container body 131 is supported by the guides 141, the cap 132 is connected to the hopper 142, and the gear 133 meshes with the drive gear 143. Then, the drive motor 144 operates when the image forming device 120 forms an image.

Accordingly, a driving force of the drive motor 144 is transmitted to the container body 131 via the drive gear 143 and the gear 133 which have meshed with each other, so that the container body 131 rotates relative the cap 132. As a result, toner inside the container body 131 moves toward the cap 132 along the helical projection 134, and is then supplied to the image forming device 120 through the cap 132 and the hopper 142. That is, consumption of toner by the image forming device 120 gradually reduces an amount of toner inside the container body 131.

As illustrated in FIG. 4A, the toner bottle accommodation portion 140 includes the four electrodes 145, 146, 147, and 148. Each of the four electrodes 145, 146, 147, and 148 is made of a conductive (e.g., iron) plate. The four electrodes 145, 146, 147, and 148 have cross sections (along the line B-B of FIG. 3A) having arc shapes along an outer circumferential surface of the toner bottle 130. The four electrodes 145, 146, 147, and 148 extend along an axial direction of the container body 131.

Moreover, the four electrodes 145, 146, 147, and 148 are arranged so as to surround the toner bottle 130 accommodated in the toner bottle accommodation portion 140. In the present embodiment, the electrodes 145, 146, 147, and 148 are respectively positioned in an upper right corner, an upper left corner, a lower right corner, and a lower left corner of the toner bottle 130.

More particularly, when the toner bottle 130 is not eccentric inside the toner bottle accommodation portion 140, an inner circumferential surface of each of the four electrodes 145 through 148 forms one segment of a circle that is concentric with the outer circumferential surface of the toner bottle 130. That is, when the toner bottle 130 is not eccentric inside the toner bottle accommodation portion 140, distances between the toner bottle 130 and the four electrodes 145 through 148 are equal.

Moreover, the four electrodes 145 through 148 are spaced a certain distance apart in a circumferential direction. In the example illustrated in FIG. 4A, a distance between an upper left end of the electrode 145 and an upper right end of the electrode 146, a distance between a lower right end of the electrode 145 and an upper right end of the electrode 147, a distance between a lower left end of the electrode 146 and an upper left end of the electrode 148, and a distance between a lower left end of the electrode 147 and a lower right end of the electrode 148 are set to be equal.

However, the shape and the arrangement of the electrodes 145 through 148 are not limited to the example illustrated in FIG. 4A. Another example is illustrated in FIG. 4B. An upper left end of an electrode 145A illustrated in FIG. 4B is longer than the upper left end of the electrode 145 illustrated in FIG. 4A, and extends toward an electrode 146A. Similarly, an upper right end of an electrode 146A illustrated in FIG. 4B is longer than the upper right end of the electrode 146 illustrated in FIG. 4A, and extends toward the electrode 145A. As a result, a distance between the upper left end of the electrode 145A and the upper right end of the electrode 146A is shorter than a distance between a lower right end of the electrode 145A and an upper right end of an electrode 147, a distance between a lower left end of the electrode 146A and an upper left end of the electrode 148, and a distance between a lower left end of the electrode 147 and a lower right end of an electrode 148.

Figure 5:
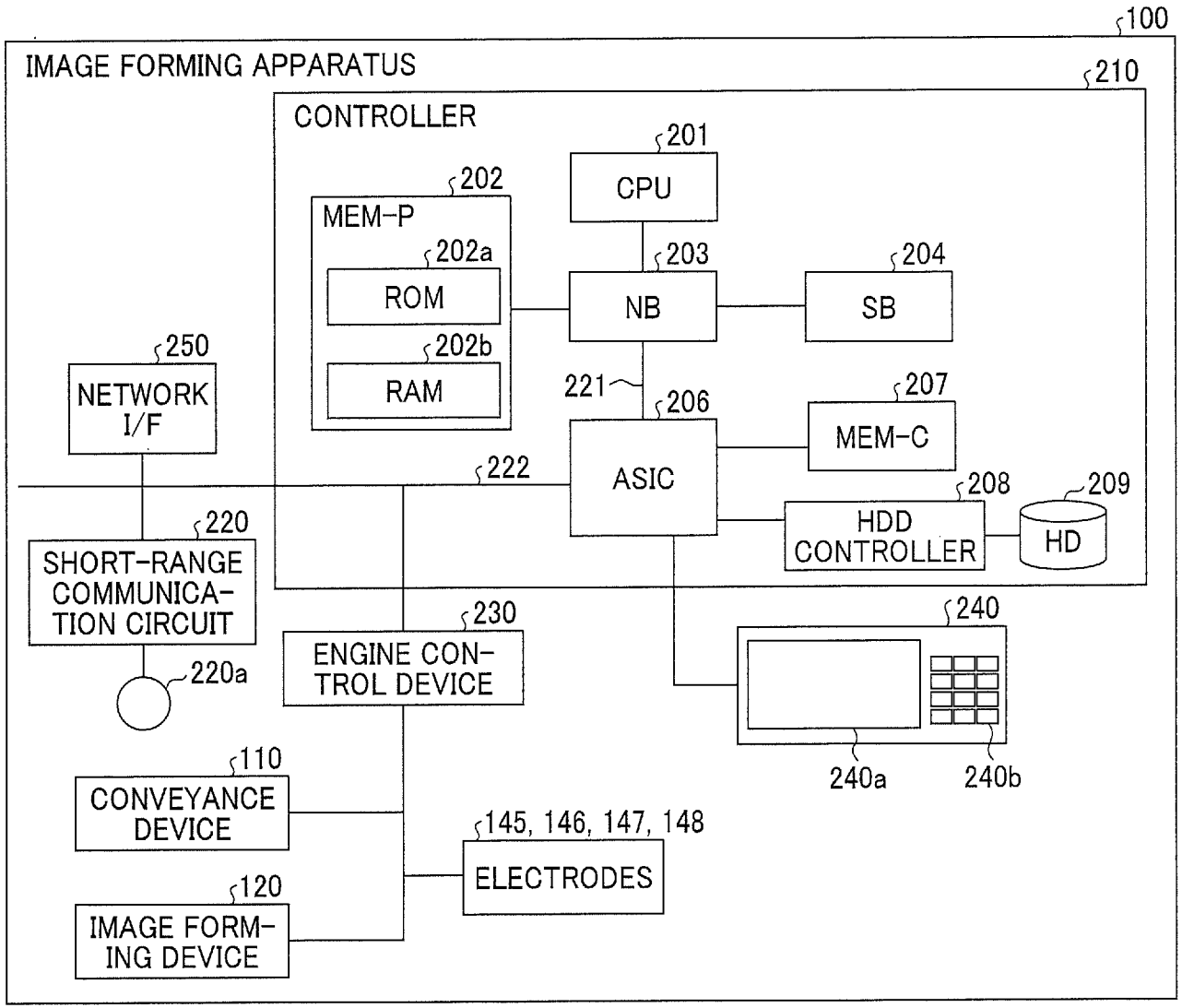
FIG. 5 is a diagram illustrating a hardware configuration of the image forming apparatus.

FIG. 5 is a diagram illustrating a hardware configuration of the image forming apparatus 100 (a multifunction peripheral/product/printer (MFP). As illustrated in FIG. 5, the image forming apparatus 100 includes a controller 210, a short-range communication circuit 220, an engine control device 230, a control panel 240, and a network interface (I/F) 250.

The controller 210 includes a central processing unit (CPU) 201 that is a main unit of a computer, a system memory (hereinafter called a MEM-P) 202, a northbridge (NB) 203, a southbridge (SB) 204, an application specific integrated circuit (ASIC) 206, a local memory (hereinafter called a MEM-C) 207 that is a storing unit, a hard disk drive (HDD) controller 208, and a hard disk (HD) 209 that is a storing unit. The NB 203 and the ASIC 206 are connected by an accelerated graphics port (AGP) bus 221.

The CPU 201 is a control unit that comprehensively controls the image forming apparatus 100. The NB 203 is a bridge that connects the CPU 201 to the MEM-P 202, the SB 204, and the AGP bus 221. The NB 203 includes a peripheral component interconnect (PCI) master and an AGP target, and a memory controller that controls operations such as reading from and writing in the MEM-P 202.

The MEM-P 202 includes a read only memory (ROM) 202*a* and a random access memory (RAM) 202*b*. The ROM 202*a* is a memory that stores data and programs for implementing each function of the controller 210. The RAM 202*b* is used, for example, as a memory to which a program or data is loaded, and as a memory for drawings when a memory printing is performed. The program stored in the RAM 202*b* can be recorded and provided as a file in an installable format or executable format in a computer readable recording medium such as a compact disc read only memory (CD-ROM), a compact disc recordable (CD-R), and a digital versatile disc (DVD).

The SB 204 is a bridge that connects the NB 203 to a PCI device and a peripheral device. The ASIC 206 is an image-processing-purpose integrated circuit (IC) including a hardware element for image processing. The ASIC 206 has a bridge function of connecting each of the AGP bus 221, a PCI bus 222, the HDD controller 208, and the MEM-C 207. The ASIC 206 includes a PCI target and an AGP master, an arbiter (ARB) serving as a core of the ASIC 206, a memory controller that controls the MEM-C 207, a plurality of direct memory access controllers (DMACs) that, for example, rotate image data according to a hardware logic, and a PCI unit that transfers data between the ASIC 206 and the engine control device 230 via the PCI bus 222. An interface such as a universal serial bus (USB) interface and an Institute of Electrical and Electronics Engineers (IEEE) 1394 interface can be connected to the ASIC 206.

The MEM-C 207 is a local memory that is used as an image buffer for copying and as a code buffer. The HD 209 is a storage in which image data, font data to be used at the time of printing, and forms are stored. The HD 209 controls reading or writing data with respect to the HD 209 according to the control by the CPU 201. The AGP bus 221 is a bus interface for a graphic accelerator card that is designed to accelerate a graphic process. The AGP bus 221 directly accesses the MEM-P 202 with high throughput, thereby making a graphics accelerator card faster.

The short-range communication circuit 220 includes a short-range communication circuit 220*a*. The short-range communication circuit 220 is a communication circuit such as a near field communication (NFC) circuit and a Bluetooth (registered trademark) communication circuit. The engine control device 230 is connected to the conveyance device 110, the image forming device 120, and the four electrodes 145 through 148.

The controller 210 controls the conveyance device 110 and the image forming device 120 via the engine control device 230, so that an image is formed on a sheet M. Moreover, the controller 210 measures an electrostatic capacity value between two electrodes adjacent each other out of the four electrodes 145 through 148, and detects an amount of toner remaining (hereinafter also referred to as a remaining toner amount) inside the toner bottle 130 based on the measured electrostatic capacity value. The four electrodes 145 through 148 and the image forming device 120 form a remaining toner amount detection device.

The control panel 240 includes a panel display 240*a* and an operation panel 240*b*. The panel display 240*a* such as a touch panel displays a current setting value or a screen such as a selection screen to receive an input from an operator. The operation panel 240*b* includes a numeric keypad that receives a setting value for a condition relating to image formation, and keys including a start key that receives a copy start instruction. The setting value for a condition relating to image formation is, for example, a density setting condition.

The network I/F 250 is an interface for data communication by using a communication network. The short-range communication circuit 220 and the network I/F 250 are electrically connected to the ASIC 206 via the PCI bus 222. The controller 210 can transmit and receive data to and from an external device via the network I/F 250.

Figure 6:
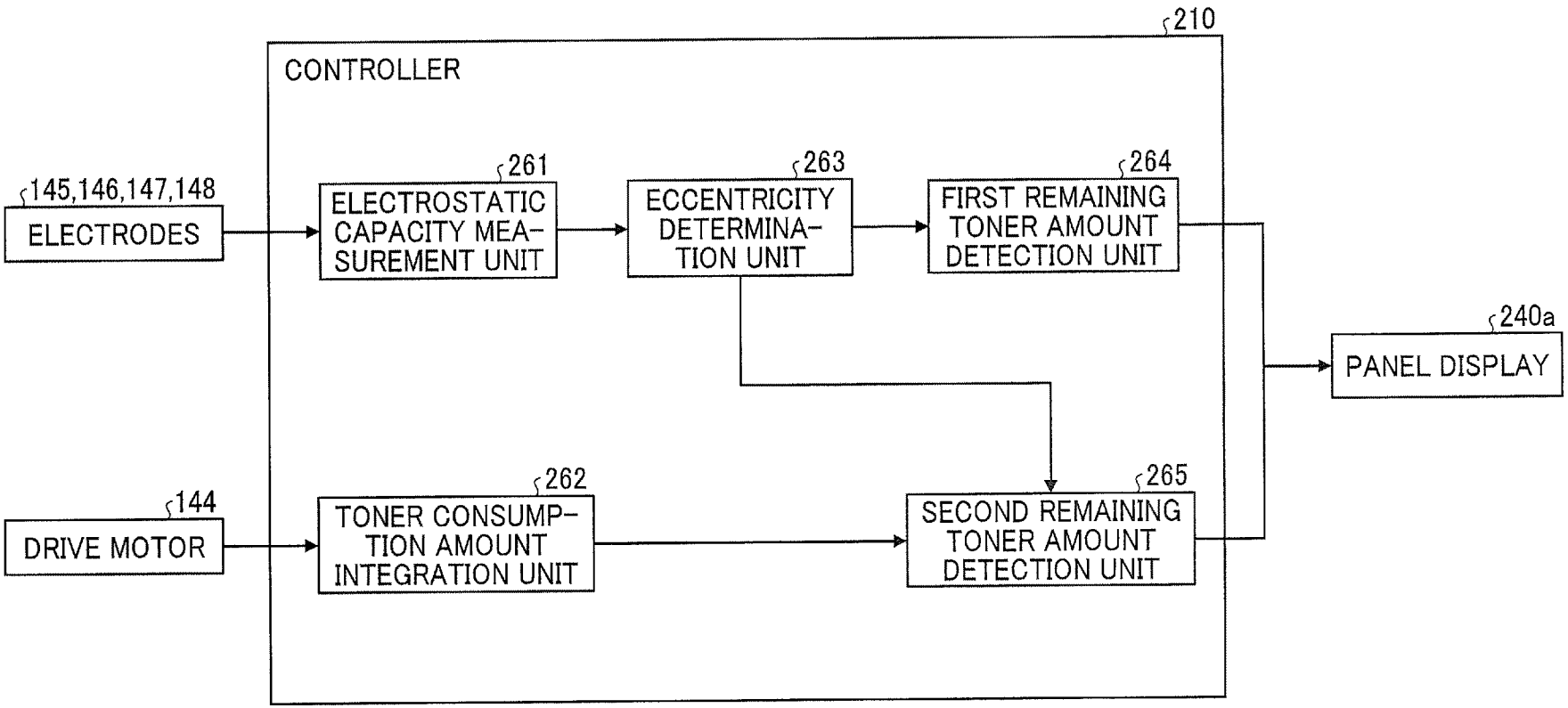
FIG. 6 is a functional block diagram illustrating a controller.

FIG. 6 is a functional block diagram of the controller 210. As illustrated in FIG. 6, the controller 210 includes an electrostatic capacity measurement unit 261, a toner consumption amount integration unit 262, an eccentricity determination unit 263, a first remaining toner amount detection unit 264, and a second remaining toner amount detection unit 265. Each of the functional blocks 261 through 265 illustrated in FIG. 6 is a functional unit that is realized if the CPU 201 inside the controller 210 loads a program stored in the HD 209 to the RAM 202*b* and executes an operation.

The electrostatic capacity measurement unit 261 measures an electrostatic capacity value between two electrodes selected from the four electrodes 145 through 148. More particularly, the electrostatic capacity measurement unit 261 measures an electrostatic capacity value between each of two pairs of horizontally adjacent electrodes, that is, an electrostatic capacity value between the electrodes 145 and 146, and an electrostatic capacity value between the electrodes 147 and 148. The electrostatic capacity measurement unit 261 also measures electrostatic capacity values between two pairs of vertically adjacent electrodes, that is, an electrostatic capacity value between the electrodes 145 and 147, and an electrostatic capacity value between the electrodes 146 and 148. A general method may be employed as a method for measuring an electrostatic capacity value. In the present embodiment, however, an electrostatic capacity value is measured by a charging method (a constant voltage/current is applied between electrodes, and an electrostatic capacity value is measured based on a relation between a time and the voltage/current at a charging achieved point).

The toner consumption amount integration unit 262 integrates an amount of toner (hereinafter referred to as a toner consumption amount) consumed by the image forming device 120. Moreover, the toner consumption amount integration unit 262 resets the integrated toner consumption amount at a time when the toner bottle 130 is replaced. A toner consumption amount integration method is not limited to a particularly method. For example, a pulse signal to be output from a rotary encoder of the drive motor 144 may be integrated.

The eccentricity determination unit 263 determines that an eccentric amount of the toner bottle 130 falls within a permissible range if at least one of the electrostatic capacity values measured by the electrostatic capacity measurement unit 261 falls within a threshold range. On the other hand, the eccentricity determination unit 263 determines that an eccentric amount of the toner bottle 130 exceeds the permissible range if both of the electrostatic capacity values measured by the electrostatic capacity measurement unit 261 are out of the threshold range.

Figure 9A:
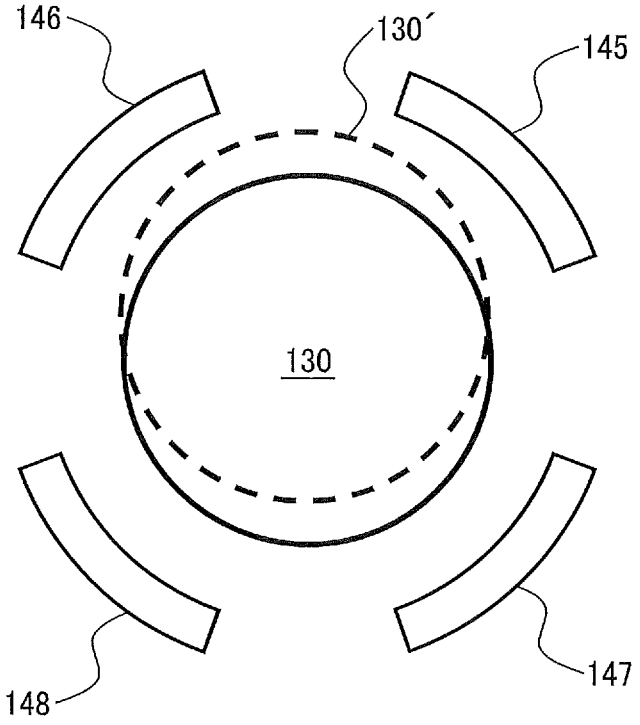
FIGS. 9A and 9B are diagrams each illustrating a positional relation between an eccentric toner bottle and electrodes.
Figure 9B:
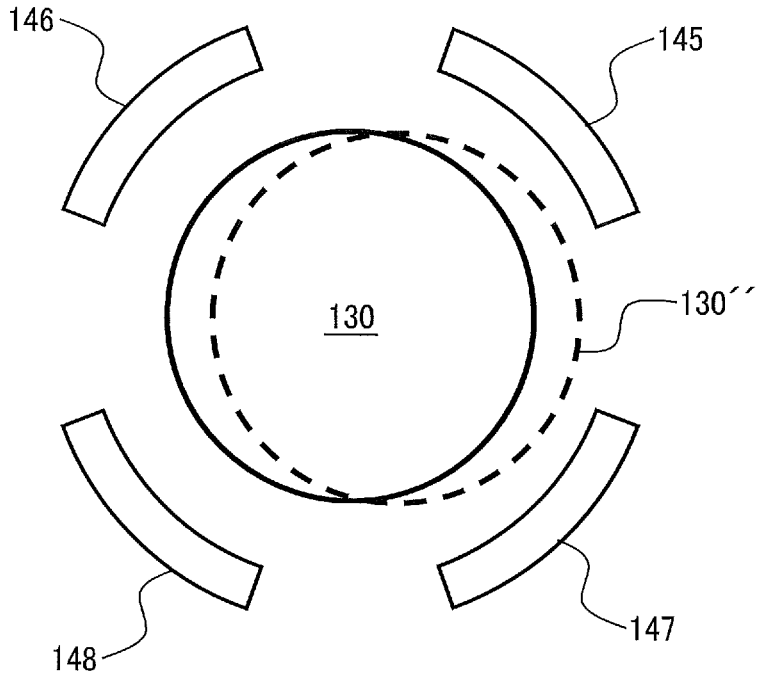

More particularly, an electrostatic capacity value between each of both two pairs of the horizontally adjacent electrodes 145 and 146 and the horizontally adjacent electrodes 147 and 148 may be out of an upper-lower threshold range. In such a case, as illustrated in FIG. 9A, the eccentricity determination unit 263 determines that an eccentric amount of the toner bottle 130 in a vertical direction exceeds a permissible range. Moreover, an electrostatic capacity value between each of both two pairs of the vertically adjacent electrodes 145 and 147 and the vertically adjacent electrodes 146 and 148 may be out of a left-right threshold range. In such a case, as illustrated in FIG. 9B, the eccentricity determination unit 263 determines that an eccentric amount of the toner bottle 130 in a horizontal direction exceeds the permissible range.

If the eccentricity determination unit 263 determines that an eccentric amount of the toner bottle 130 falls within the permissible range, the eccentricity determination unit 263 causes the first remaining toner amount detection unit 264 to detect a remaining toner amount inside the toner bottle 130. On the other hand, if the eccentricity determination unit 263 determines that an eccentric amount of the toner bottle 130 exceeds the permissible range, the eccentricity determination unit 263 causes the second remaining toner amount detection unit 265 to detect a remaining toner amount inside the toner bottle 130.

The first remaining toner amount detection unit 264 detects a remaining toner amount inside the toner bottle 130 accommodated in the toner bottle accommodation portion 140 based on the electrostatic capacity value measured by the electrostatic capacity measurement unit 261. An electrostatic capacity value to be measured by the electrostatic capacity measurement unit 261 varies depending on a permittivity between electrodes. Thus, the larger the amount of the toner inside the toner bottle 130 (the higher the permittivity with respect to the air), the greater the electrostatic capacity value. Accordingly, the first remaining toner amount detection unit 264, based on a correspondence relation between an electrostatic capacity value and a remaining toner amount, detects a remaining toner amount corresponding to the electrostatic capacity value measured by the electrostatic capacity measurement unit 261 as a current remaining toner amount. The correspondence relation is stored beforehand in the HD 209 (a memory).

The first remaining toner amount detection unit 264 detects a remaining toner amount based on a representative value of the four electrostatic capacity values measured by the electrostatic capacity measurement unit 261. The representative value can be, for example, one of the four electrostatic capacity values, or a value such as an average value (a simple average value, a weighted average value), a median, and a mode of the four electrostatic capacity values. In addition to the electrostatic capacity value for determination of eccentricity of the toner bottle 130, the first remaining toner amount detection unit 264 may cause the electrostatic capacity measurement unit 261 to measure an electrostatic capacity value for detection of a remaining toner amount.

The second remaining toner amount detection unit 265 detects a remaining toner amount inside the toner bottle 130 accommodated in the toner bottle accommodation portion 140 based on a toner consumption amount integrated by the toner consumption amount integration unit 262. More particularly, the second remaining toner amount detection unit 265 subtracts a current toner consumption amount integrated by the toner consumption amount integration unit 262 from an amount of toner inside a new toner bottle 130, thereby detecting a remaining toner amount.

Then, each of the first remaining toner amount detection unit 264 and the second remaining toner amount detection unit 265 displays the detected remaining toner amount on the panel display 240*a*. Such display of the remaining toner amount on the panel display 240*a* is one example of an output of the remaining toner amount. However, a particular method for outputting a remaining toner amount is not limited to the aforementioned example. Information about a remaining toner amount may be transmitted to an external device via the network I/F 250, or warning sound may be output from a speaker if a remaining toner amount is less than a predetermined amount.

Figure 7:
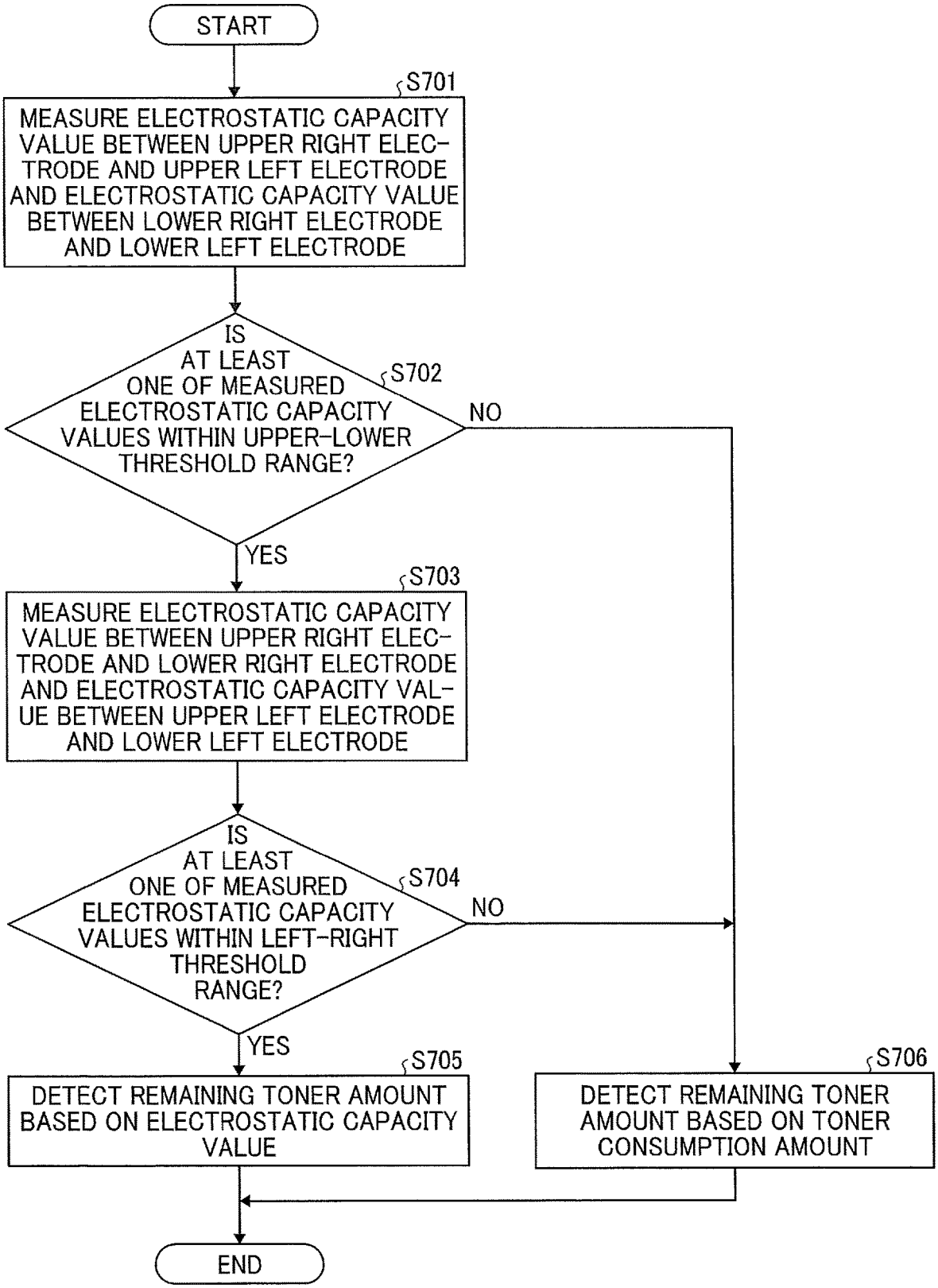
FIG. 7 is a flowchart illustrating a process for detecting a remaining toner amount.
Figure 8:
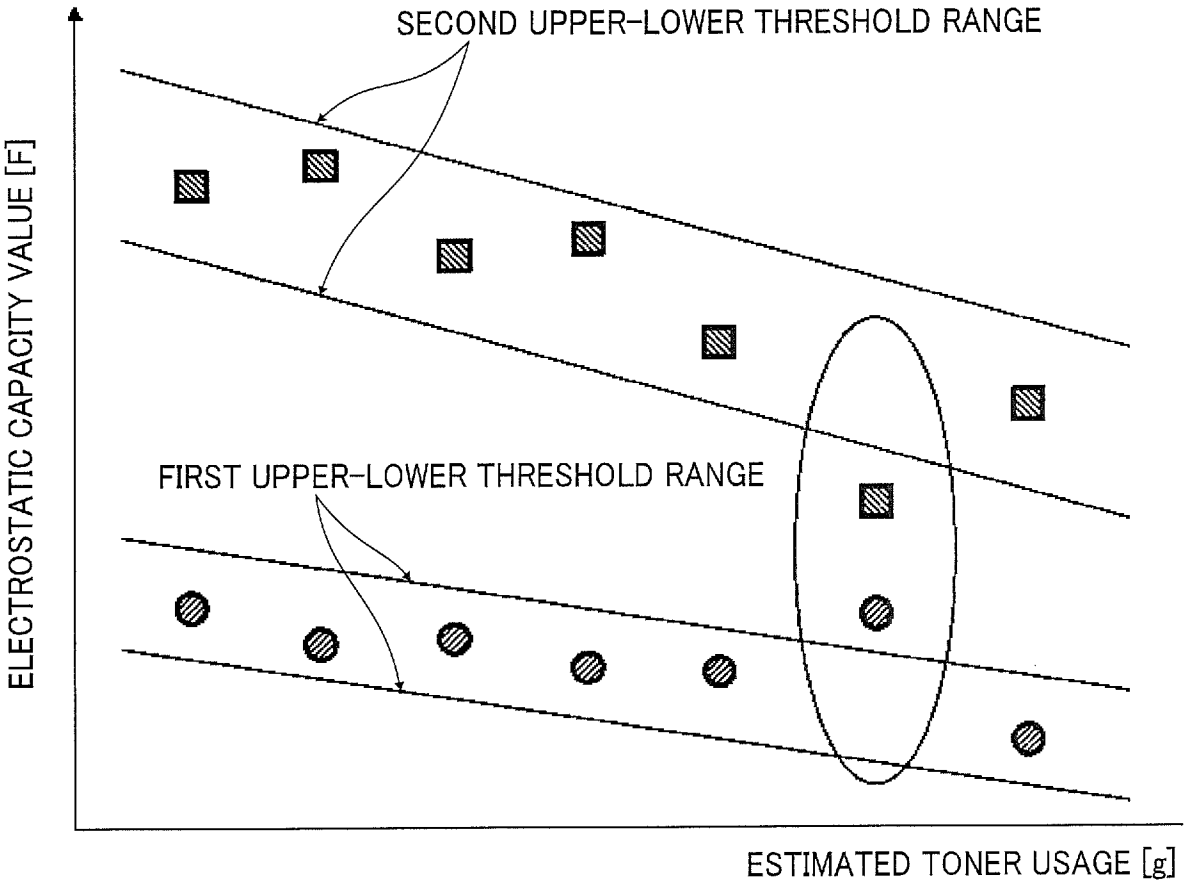
FIG. 8 is a diagram illustrating a relation between an electrostatic capacity value measurement result and a threshold range.

Next, a remaining toner amount detection process is described with reference to FIGS. 7 through 9. FIG. 7 is a flowchart illustrating a remaining toner amount detection process. FIG. 8 is a diagram illustrating a relation between a result of measurement of electrostatic capacity values by the electrostatic capacity measurement unit 261 and a threshold range. FIGS. 9A and 9B are diagrams each illustrating a positional relation between an eccentric toner bottle 130 and the electrodes 145 through 148.

The controller 210, for example, can execute a remaining toner amount detection process according to an instruction from an operator via the panel display 240*a*, or can repeatedly execute a remaining toner amount detection process for each predetermined time interval. The controller 210 executes the remaining toner amount detection process for each of the toner bottles 130 for the respective colors. However, since a common process is performed for each of the colors, a description is given of the process to be performed for one color.

In step S701, the electrostatic capacity measurement unit 261 of the controller 210 measures an electrostatic capacity value C1 between the electrode 145 (an upper right electrode) and the electrode 146 (an upper left electrode) which are adjacent to each other in a horizontal direction, and an electrostatic capacity value C2 between the electrode 147 (a lower right electrode) and the electrode 148 (a lower left electrode) which are adjacent to each other in the horizontal direction.

Next, in step S702, the eccentricity determination unit 263 of the controller 210 determines whether the electrostatic capacity values C1 and C2 measured in step S701 fall within an upper-lower threshold range. The upper-lower threshold range represents a numeral range that is used for determination of whether a vertically eccentric amount of the toner bottle 130 accommodated in the toner bottle accommodation portion 140 falls within a permissible range. The upper-lower threshold range is a numeric range with an upper limit and a lower limit.

Moreover, since toner is accumulated in the bottom of the container body 131, the electrostatic capacity value C2 tends to be greater than the electrostatic capacity value C1. Accordingly, as illustrated in FIG. 8, an upper-lower threshold range (a first upper-lower threshold range) to be compared with the electrostatic capacity value C1 and an upper-lower threshold range (a second upper-lower threshold range) to be compared with the electrostatic capacity value C2 may be set to different values. On the other hand, as illustrated in FIG. 4B, changes in distances between the electrodes 145 through 148 reduce a difference between the electrostatic capacity values C1 and C2. In such a case, upper-lower threshold ranges to be compared with the electrostatic capacity values C1 and C2 may be set to the same value.

Alternatively, an upper-lower threshold range may be determined based on electrostatic capacity values C1 and C2 measured last time by the electrostatic capacity measurement unit 261. For example, the eccentricity determination unit 263 may set a first upper-lower threshold range to be compared with an electrostatic capacity value C1 measured this time to a numeric range including an electrostatic capacity value C1 measured last time. The numeric range including the electrostatic capacity value C1 is acquired by, for example, multiplying the electrostatic capacity value C1 by ±X % (i.e., C1±X %).

For example, if a coefficient X=10%, 0.9 C1 ≤upper-lower threshold range ≤1.1 C1 is provided. The coefficient X can be a predetermined fixed value, or a variable value that increases with time that has elapsed from measurement of an electrostatic capacity value C1 last time. Similarly, the second upper-lower threshold range is calculated. However, a particular method for calculating a threshold range is not limited to the aforementioned example.

If a toner bottle 130' is eccentric upward as illustrated in FIG. 9A, an electrostatic capacity value C1 is greater than an upper limit of the first upper-lower threshold range, and an electrostatic capacity value C2 is smaller than a lower limit of the second upper-lower threshold range, as illustrated with a plot indicated by a circle illustrated in FIG. 8. On the other hand, if a toner bottle 130 is eccentric downward, an electrostatic capacity value C1 is smaller than a lower limit of the first upper-lower threshold range, and an electrostatic capacity value C2 is greater than an upper limit of the second upper-lower threshold range.

Subsequently, if the eccentricity determination unit 263 determines that at least one of the electrostatic capacity values C1 and C2 falls within the upper-lower threshold range (YES in step S702), the process proceeds to step S703. In step S703, the electrostatic capacity measurement unit 261 of the controller 210 measures an electrostatic capacity value C3 between the electrode 145 (the upper right electrode) and the electrode 147 (the lower right electrode) which are adjacent to each other in a vertical direction, and an electrostatic capacity value C4 between the electrode 146 (the upper left electrode) and the electrode 148 (the lower left electrode) which are adjacent to each other in the vertical direction.

In step S704, the eccentricity determination unit 263 of the controller 210 determines whether the electrostatic capacity values C3 and C4 measured in step S703 fall within a left-right threshold range. The left-right threshold range is a numeric range for determination of whether a horizontally eccentric amount of the toner bottle 130 accommodated in the toner bottle accommodation portion 140 falls within a permissible range. Since the left-right threshold range is similar to the above-described upper-lower threshold range, a detailed description of the left-right threshold range is omitted. The left-right threshold range to be compared with the electrostatic capacity values C3 and C4 may be the same value.

If a toner bottle 130" is eccentric rightward as illustrated in FIG. 9B, an electrostatic capacity value C3 is greater than an upper limit of the left-right threshold range, and an electrostatic capacity value C4 is smaller than a lower limit of the left-right threshold range. On the other hand, if a toner bottle 130 is eccentric leftward, an electrostatic capacity value C3 is smaller than a lower limit of the left-right threshold range, and an electrostatic capacity value C4 is greater than an upper limit of the left-right threshold range.

Subsequently, if the eccentricity determination unit 263 determines that at least one of the electrostatic capacity values C3 and C4 falls within the left-right threshold range (YES in step S704), the process proceeds to step S705. In step S705, the first remaining toner amount detection unit 264 of the controller 210 detects a remaining toner amount based on the electrostatic capacity value measured by the electrostatic capacity measurement unit 261, and displays the detected remaining toner amount on the panel display 240*a*.

On the other hand, if the eccentricity determination unit 263 determines that both of the electrostatic capacity values C1 and C2 are out of the upper-lower threshold range (NO in step S702), or the eccentricity determination unit 263 determines that both of the electrostatic capacity values C3 and C4 are out of the left-right threshold range (NO in step S704), the process proceeds to step S706. In step S706, the second remaining toner amount detection unit 265 of the controller 210 detects a remaining toner amount based on a toner consumption amount integrated by the toner consumption amount integration unit 262, and displays the detected remaining toner amount on the panel display 240*a*.

According to the above-described embodiment, if an eccentric amount of the toner bottle 130 accommodated inside the toner bottle accommodation portion 140 falls within a permissible range (YES in step S702 and YES in step S704), a remaining toner amount based on an electrostatic capacity value is detected. On the other hand, if an eccentric amount of the toner bottle 130 inside the toner bottle accommodation portion 140 exceeds the permissible range (NO in step S702 or NO in step S704), a remaining toner amount is detected based on a toner consumption amount integrated by software instead of detection of a remaining toner amount based on the electrostatic capacity value. Accordingly, an accurate remaining toner amount can be output regardless of orientation of the toner bottle 130.

The process in steps S701 and S702 and the process in steps S703 and S704 can be executed in order as illustrated in FIG. 7 or in reverse order. Alternatively, first, the electrostatic capacity measurement unit 261 may execute the process in steps S701 and S703, and then the eccentricity determination unit 263 may execute the process in steps S702 and S704.

According to the above-described embodiment, if both of a vertically eccentric amount of the toner bottle 130 and a horizontally eccentric amount of the toner bottle 130 fall within a permissible range, a remaining toner amount is detected based on an electrostatic capacity value. Thus, the eccentricity of the toner bottle 130 can be ascertained more accurately. Only one of the process in steps S701 and S702 and the process in steps S703 and S704 may be executed, and the other may be omitted.

According to the above-described embodiment, a threshold range to be compared with an electrostatic capacity value measured this time is determined based on an electrostatic capacity value measured last time. Thus, an eccentric amount of the toner bottle 130 can be determined in a threshold range for the current remaining toner amount.

In general, an electrophotographic image forming apparatus rotates a toner bottle to supply toner to a photoconductor drum. Such rotation of the toner bottle can cause the toner bottle to be eccentric with respect to a rotation axis. As a result, there are cases where a remaining toner amount cannot be accurately detected based on a detected electrostatic capacity value due to a change in a distance between the toner bottle and a pair of electrodes.

According to the above-described embodiment, however, an amount of toner remaining in a toner bottle attached to an image forming apparatus can be detected accurately.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The present disclosure has been described above with reference to specific embodiments but is not limited thereto. Various modifications and enhancements are possible without departing from scope of the disclosure. It is therefore to be understood that the present disclosure may be practiced otherwise than as specifically described herein. For example, elements and/or features of different illustrative embodiments may be combined with each other and/or substituted for each other within the scope of the present disclosure.

What is claimed is:

1. A remaining toner amount detection device comprising:

four electrodes each of which is formed in an arc shape along an outer circumferential surface of a toner bottle and that are spaced a certain distance apart in a circumferential direction so as to surround the toner bottle; and a controller configured to detect a remaining toner amount inside the toner bottle by using the four electrodes, the controller being configured to:

determine whether at least one of a first electrostatic capacity value between one pair of electrodes adjacent to each other and a second electrostatic capacity value between the other pair of electrodes adjacent to each other out of the four electrodes falls within a threshold range; and in response to a determination that at least one of the first electrostatic capacity value and the second electrostatic capacity value falls within the threshold range, detect a remaining toner amount inside the toner bottle based on an electrostatic capacity value and output the detected remaining toner amount.

2. The remaining toner amount detection device according to claim 1, wherein the one pair of electrodes are adjacent to each other in a horizontal direction and the other pair of electrodes are adjacent to each other in the horizontal direction, and wherein the controller is configured to detect the remaining toner amount inside the toner bottle based on the electrostatic capacity value in response to a determination that not only the at least one of the first electrostatic capacity value and the second electrostatic capacity value falls within an upper-lower threshold range but also at least one of a third electrostatic capacity value between one pair of electrodes adjacent to each other in a vertical direction and a fourth electrostatic capacity value between the other pair of electrodes adjacent to each other in the vertical direction out of the four electrodes falls within a left-right threshold range.

3. The remaining toner amount detection device according to claim 1, wherein the controller is configured to set a certain numeric range including an electrostatic capacity value measured last time to the threshold range to be compared with an electrostatic capacity value measured this time.

4. The remaining toner amount detection device according to claim 1, wherein the controller is configured to detect the remaining toner amount inside the toner bottle based on a representative value of a plurality of electrostatic capacity values measured using the four electrodes.

5. The remaining toner amount detection device according to claim 1, wherein a distance between a pair of electrodes horizontally adjacent to each other above the toner bottle out of the four electrodes is shorter than a distance between any other pair of electrodes of the four electrodes.

6. An image forming apparatus comprising:

the remaining toner amount detection device according to claim 1; and an image forming device configured to form an image on a medium with toner inside the toner bottle.

7. The image forming apparatus according to claim 6, wherein the controller is configured to:

integrate a toner consumption amount that is an amount of toner consumed by the image forming device; and detect the remaining toner amount inside the toner bottle based on the integrated toner consumption amount in response to a determination that both of the first electrostatic capacity value and the second electrostatic capacity value are out of the threshold range.

8. A method for detecting a remaining toner amount, the method comprising:

determining whether at least one of a first electrostatic capacity value between one pair of electrodes adjacent to each other and a second electrostatic capacity value between the other pair of electrodes adjacent to each other out of the four electrodes falls within a threshold range, the four electrodes being formed in arc shapes and spaced a certain distance apart along an outer circumferential surface of a toner bottle; and detecting a remaining toner amount inside the toner bottle based on an electrostatic capacity value and outputting the detected remaining toner amount, in response to a determination that at least one of the first electrostatic capacity value and the second electrostatic capacity falls within the threshold range.

* * * * *